US010995758B2

(12) United States Patent
Jang et al.

(10) Patent No.: US 10,995,758 B2
(45) **Date of Patent: *May 4, 2021**

(54) PUMP FOR CIRCULATING WATER TO PREVENT NOISE DURING TRANSITION STATE

(71) Applicant: NEW MOTECH CO., LTD., Gwangju (KR)

(72) Inventors: Jeong Cheol Jang, Gwangju (KR); Kyoung Joo Lee, Gwangju (KR); Hyun Sung Yang, Gwangju (KR); Min Seok Kang, Gwangju (KR)

(73) Assignee: NEW MOTECH CO., LTD., Gwangju (KR)

( * ) Notice: Subject to any disclaimer, the term of this patent is extended or adjusted under 35 U.S.C. 154(b) by 32 days.

This patent is subject to a terminal disclaimer.

(21) Appl. No.: 16/331,145

(22) PCT Filed: Sep. 18, 2017

(86) PCT No.: PCT/KR2017/010183
§ 371 (c)(1),
(2) Date: Mar. 7, 2019

(87) PCT Pub. No.: WO2018/084429
PCT Pub. Date: May 11, 2018

(65) Prior Publication Data

US 2019/0219056 A1 Jul. 18, 2019

(30) Foreign Application Priority Data

Nov. 3, 2016 (KR) ..... 10-2016-0145500

(51) Int. Cl.
*F04D 13/06* (2006.01)
*F04D 29/22* (2006.01)
(Continued)

(52) U.S. Cl.
CPC ..... *F04D 13/0606* (2013.01); *F04D 29/2222* (2013.01); *F04D 29/406* (2013.01); *F04D 29/426* (2013.01); *F04D 29/669* (2013.01)

(58) Field of Classification Search
CPC ..... F04D 13/02; F04D 13/06; F04D 13/0606; F04D 13/0626; F04D 13/0633;
(Continued)

(56) References Cited

U.S. PATENT DOCUMENTS 10,502,224 B2 * 12/2019 Jang ..... F04D 29/669
2006/0251513 A1 * 11/2006 Kalavsky ..... F04D 29/426 415/206
2016/0327050 A1 11/2016 Nakaniwa et al.

FOREIGN PATENT DOCUMENTS

EP 2434160 A1 * 3/2012 ..... H02K 1/28
JP 10-115295 A 5/1998
(Continued)

OTHER PUBLICATIONS

International Search Report for PCT/KR2017/010183 dated Dec. 22, 2017 from Korean Intellectual Property Office.

*Primary Examiner* — Charles G Freay
*Assistant Examiner* — Chirag Jariwala
(74) *Attorney, Agent, or Firm* — Revolution IP, PLLC

(57) ABSTRACT

A pump for circulating water includes an upper housing 10 formed with an inlet 11 and an outlet 12 of fluid; a lower housing 20 arranged in a lower side of the upper housing 10, having a space formed therein; an inner housing 30 having an edge part interposed between the upper housing 10 and the lower housing 20, and an impeller receiving space 31 formed in a middle part; an impeller 50 received inside the upper housing 10 and in the impeller receiving space 31 to be rotatably installed; a rotor 60 installed inside an outer circumference of the impeller 50; a spring 65 installed
(Continued)

between a lower surface of the impeller and the inner housing; and a stator 70 installed inside the lower housing 20.

4 Claims, 5 Drawing Sheets

(51) Int. Cl.
*F04D 29/42* (2006.01)
*F04D 29/66* (2006.01)
*F04D 29/40* (2006.01)

(58) Field of Classification Search
CPC ..... F04D 29/007; F04D 29/04; F04D 29/043; F04D 29/044; F04D 29/406; F04D 29/426; F04D 29/2222; F04D 29/669; F04D 25/026; F04D 25/06
USPC ..... 417/423.1, 423.8, 423.12, 423.14, 366, 417/369, 370
See application file for complete search history.

(56) References Cited

FOREIGN PATENT DOCUMENTS

| | | | | | |
|---|---|---|---|---|---|
| JP | 2015-148165 | A | | 8/2015 | |
| KR | 10-2011-0088029 | A | | 8/2011 | |
| KR | 20110088029 | A | * | 8/2011 | ..... F04D 13/0653 |
| KR | 10-2012-0057008 | A | | 6/2012 | |
| KR | 20120057008 | A | * | 6/2012 | ..... F04D 13/06 |
| KR | 10-1204344 | B1 | | 11/2012 | |
| KR | 10-2015-0085241 | A | | 7/2015 | |

* cited by examiner

[Fig. 1]
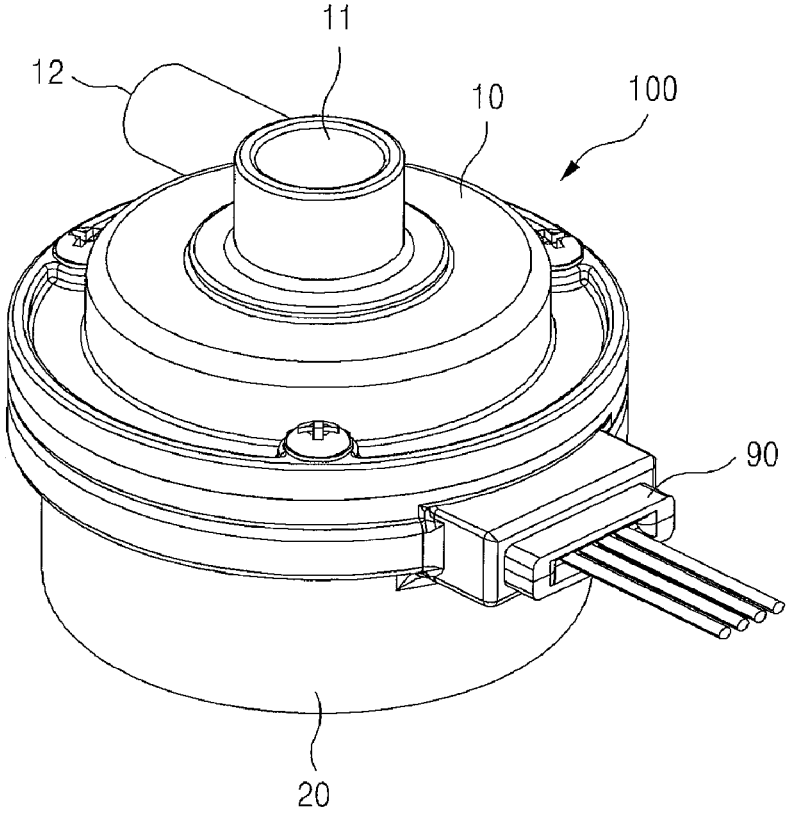

[Fig. 2]
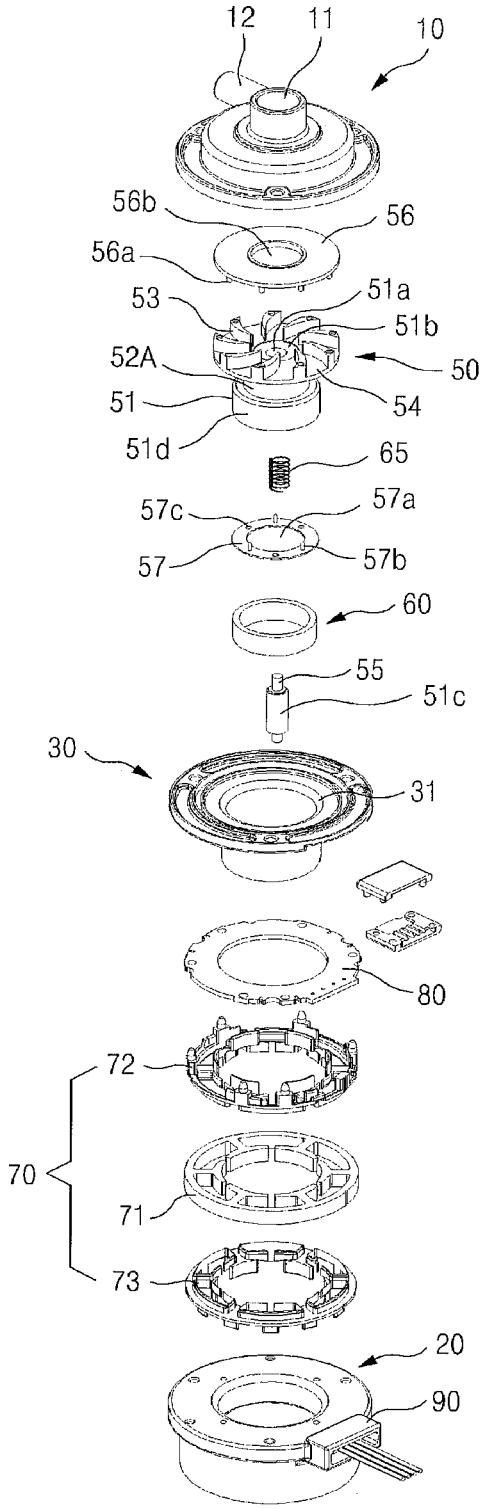

[Fig. 3]
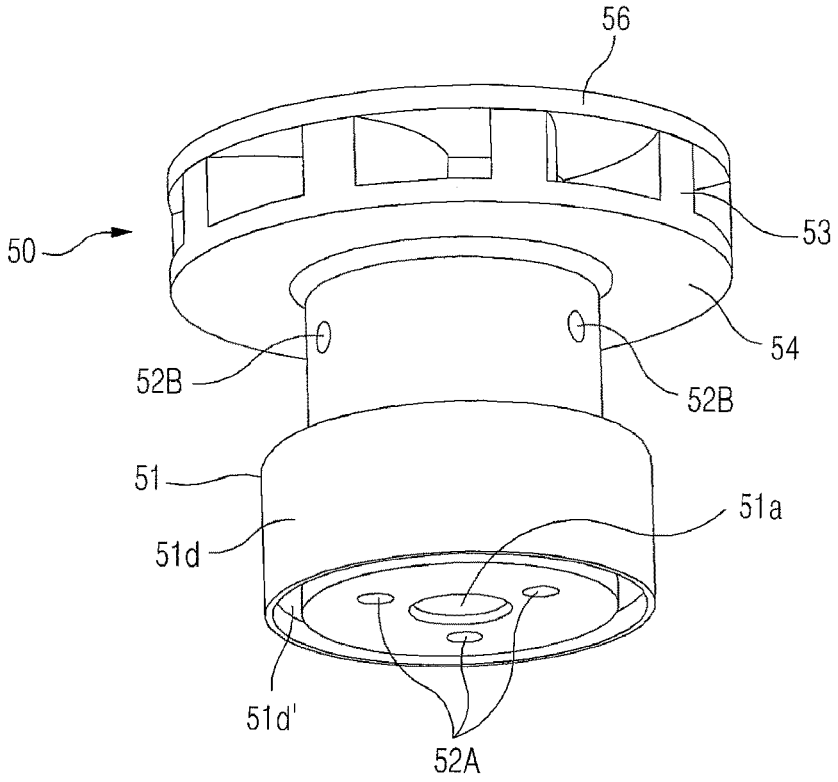
[Fig. 4]
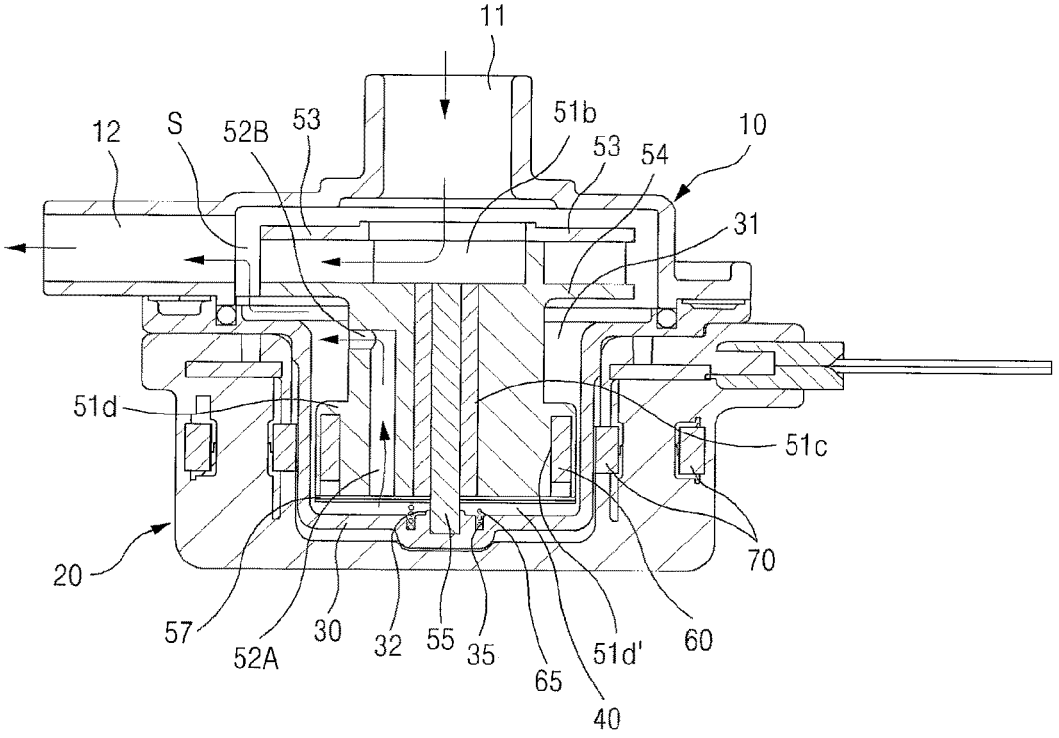

[Fig. 5]
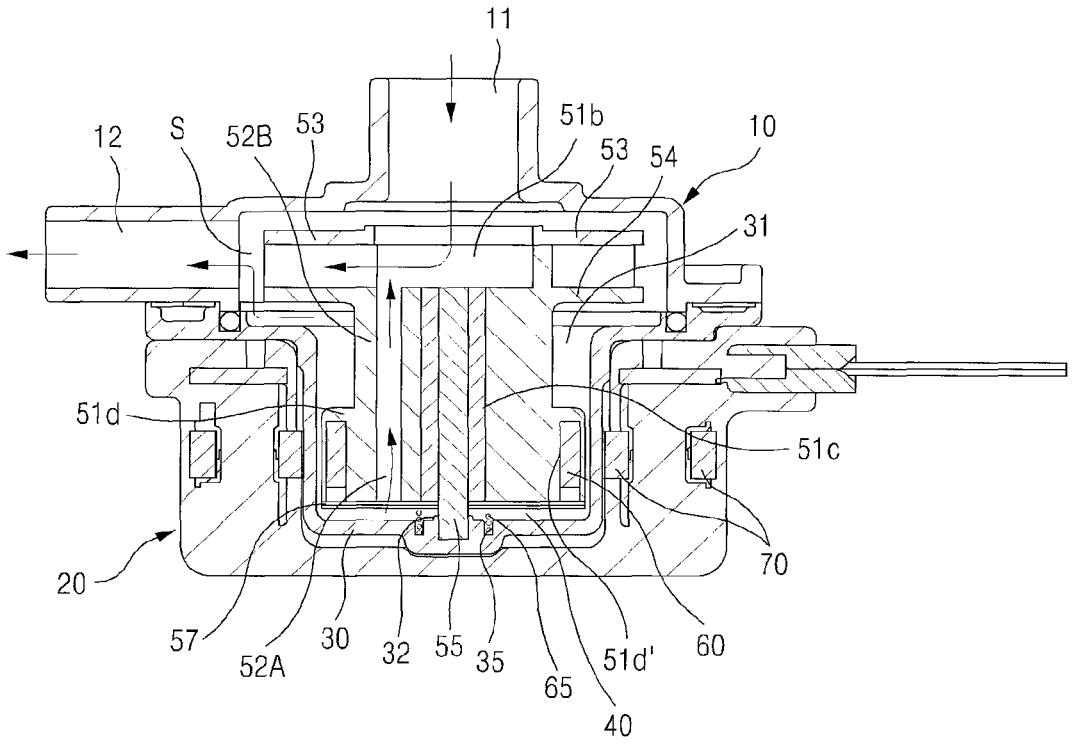
[Fig. 6]
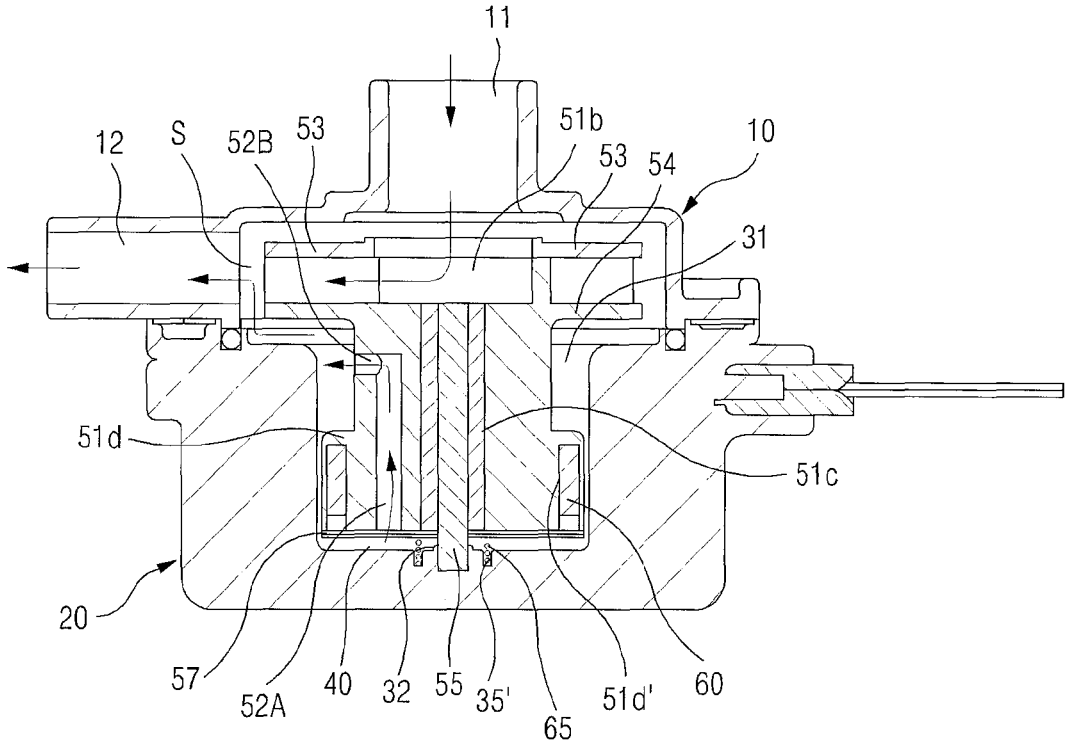

[Fig. 7]
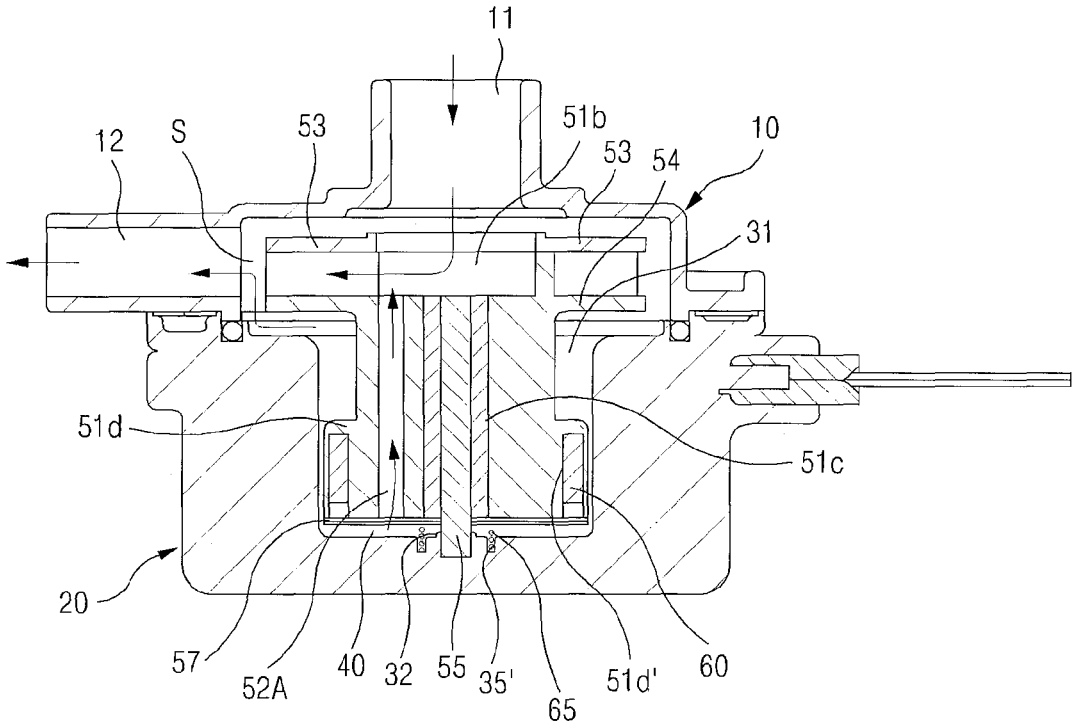

PUMP FOR CIRCULATING WATER TO PREVENT NOISE DURING TRANSITION STATE

TECHNICAL FIELD

The present invention relates to a pump for circulating water, more specifically to a pump for circulating water which secures smooth flow of fluid by preventing an impeller from being affected by the air pressure generated while discharging, to a fluid outlet, part of the fluid and air intruding into the lower part of a pump chamber, thereby allowing smooth rotation of the impeller, improves durability by preventing damage to the impeller, and also prevents noise generated when operating during a transition state.

BACKGROUND ART

In general, the pump for circulating water used for a heating mat, etc. is disclosed in prior art, Korean Patent No. 10-1204344. This patent reference provides a technology of rotating an impeller installed with a rotor by the electromagnetic induction between a stator and the rotor to introduce fluid (water) to the inlet of the lower part of the reservoir, discharging the fluid (water) through a pathway between the wing piece of an impeller body and the upper cover of the impeller by pumping, and delivering the introduced fluid along a discharge line via an outlet to a place of use such as a heating mat, etc. through a connecting line after heating the fluid by a heating means.

In particular, in the prior art, a plurality of discharge holes vertically penetrating the impeller that is interconnected with the flow pathway are formed so that the fluid in the flow pathway formed between the outer surface of the impeller body and the impeller receiving space of the inner housing is discharged upwards.

Therefore, according to the prior art, during the pumping action of the impeller, part of the water (part of the fluid) discharged through the pathway between the wing piece and the impeller upper cover and air included therein are smoothly discharged upwards while being introduced into the flow pathway formed between the outer surface of the impeller body and the impeller receiving space of the inner housing and the discharge holes vertically penetratingly formed through the impeller body. Thus, since cavitation does not occur in the flow pathway even during high speed rotation of the impeller, water is circulated smoothly. Also, since the rise of the impeller is prevented, the vibration or noise can be blocked which is generated from the contact with the inner surface of the upper housing or adjacent parts because of the rise of the impeller.

According to the structure of the prior art, no big problems arise when the impeller operates in a normal state, since the water in the flow pathway is discharged smoothly. However, the pump for circulating water according to the prior art is mainly used for a heating mat. The heating mat is usually used during sleeping. Thus, it is not necessary to circulate water all the time to maintain the temperature at a value pre-set by a user, and when the water is circulated at a temperature higher than the set value, it is required to stop water circulation for a certain period of time to maintain the temperature at the set value.

When the pump for circulating water stops operating for a certain period of time to control water circulation, air may be introduced into the flow pathway again. During the transition state where the pump for circulating water re-operates because of the air, unpleasant noise is generated when the air is discharged from the flow pathway, which is similar to the noise generated when water runs down the drain. This noise disturbs comfortable sleep of the user of the heating mat.

In order to resolve the problem, the present inventors suggest a pump for circulating water with a new structure.

DISCLOSURE OF INVENTION

Technical Problem

The present invention is to provide a structure which can effectively discharge air introduced into a flow pathway when a pump for circulating water temporarily stops operating and then re-operates.

Solution to Problem

The pump for circulating water according to a first embodiment of the present invention comprises an upper housing 10 formed with an inlet 11 and an outlet 12 of fluid; a lower housing 20 arranged in a lower side of the upper housing 10, having a space formed therein; an inner housing 30 having an edge part interposed between the upper housing 10 and the lower housing 20, and an impeller receiving space 31 formed in a middle part; an impeller 50 received inside the upper housing 10 and in the impeller receiving space 31 to be rotatably installed, so as to form a flow pathway 40 between the impeller 50 and an inner surface of the inner housing 30 for the flow of fluid; a rotor 60 installed inside an outer circumference of the impeller 50; a spring 65 installed between a lower surface of the impeller and the inner housing; and a stator 70 installed inside the lower housing 20, wherein the pump for circulating water is formed with a plurality of vertical discharge holes 52A interconnected with the flow pathway 40 in a body 51 of the impeller 50 so that the fluid inside the flow pathway 40 is discharged to the upper side, and is formed with a plurality of horizontal discharge holes 52B interconnected with the plurality of vertical discharge holes 52A.

The pump for circulating water according to a second embodiment of the present invention comprises an upper housing 10 formed with an inlet 11 and an outlet 12 of fluid; a lower housing 20 arranged in a lower side of the upper housing 10, having a space formed therein; an inner housing 30 having an edge part interposed between the upper housing 10 and the lower housing 20, and an impeller receiving space 31 formed in a middle part; an impeller 50 received inside the upper housing 10 and in the impeller receiving space 31 to be rotatably installed, so as to form a flow pathway 40 between the impeller 50 and an inner surface of the inner housing 30 for the flow of fluid; a rotor 60 installed inside an outer circumference of the impeller 50; a spring 65 installed between a lower surface of the impeller and the inner housing; and a stator 70 installed inside the lower housing 20, wherein a plurality of vertical discharge holes 52A interconnected with the flow pathway 40 are formed in a body 51 of the impeller 50 to be penetrated from the lower surface of the impeller body 51 towards the upper part of the impeller body 51, so that the fluid inside the flow pathway 40 is discharged to the upper side.

In the first and second embodiments of the present invention, preferably, a spring insertion groove in which the spring is located is formed at the center inside the inner housing.

The pump for circulating water according to a third embodiment of the present invention comprises an upper housing 10 formed with an inlet 11 and an outlet 12 of fluid; a lower housing 20 arranged in a lower side of the upper housing 10 to be combined with the upper housing, having an impeller receiving space 31 therein; an impeller 50 received inside the upper housing 10 and in the impeller receiving space 31 to be rotatably installed, so as to form a flow pathway 40 between the impeller 50 and an inner surface of the lower housing 20 for the flow of fluid; a rotor 60 installed inside an outer circumference of the impeller 50; a spring 65 installed between a lower surface of the impeller and the lower housing; and a stator 70 embedded inside the lower housing 20 to be installed, wherein the pump for circulating water is formed with a plurality of vertical discharge holes 52A interconnected with the flow pathway 40 in a body 51 of the impeller 50 so that the fluid inside the flow pathway 40 is discharged to the upper side, and is formed with a plurality of horizontal discharge holes 52B interconnected with the plurality of vertical discharge holes 52A.

The pump for circulating water according to a fourth embodiment of the present invention comprises an upper housing 10 formed with an inlet 11 and an outlet 12 of fluid; a lower housing 20 arranged in a lower side of the upper housing 10 to be combined with the upper housing, having an impeller receiving space 31 therein; an impeller 50 received inside the upper housing 10 and in the impeller receiving space 31 to be rotatably installed, so as to form a flow pathway 40 between the impeller 50 and an inner surface of the lower housing 20 for the flow of fluid; a rotor 60 installed inside an outer circumference of the impeller 50; a spring 65 installed between a lower surface of the impeller and the lower housing; and a stator 70 embedded inside the lower housing 20 to be installed, wherein a plurality of vertical discharge holes 52A interconnected with the flow pathway 40 are formed in a body 51 of the impeller 50 to be penetrated from the lower surface of the impeller body 51 towards the upper part of the impeller body 51, so that the fluid inside the flow pathway 40 is discharged to the upper side.

In the third and fourth embodiments of the present invention, preferably, a spring insertion groove in which the spring is located is formed at the center inside the lower housing.

Advantageous Effects of Invention

The present invention can more effectively discharge air in a flow pathway of an impeller not only in operation of a normal state of a pump for circulating water but also during a transition state where the pump temporarily stops operating and then re-operates. Thus, the present invention has an effect of operating the pump for circulating water without causing noise in operation of a transition state.

BRIEF DESCRIPTION OF DRAWINGS

FIG. 1 is a perspective view illustrating a pump for circulating water according to the present invention;

FIG. 2 is an exploded perspective view illustrating a pump for circulating water according to the present invention;

FIG. 3 is a perspective view illustrating an impeller of a pump for circulating water according to the present invention;

FIG. 4 is a cross-sectional view of a pump for circulating water according to the first embodiment of the present invention;

FIG. 5 is a cross-sectional view of a pump for circulating water according to the second embodiment of the present invention;

FIG. 6 is a cross-sectional view of a pump for circulating water according to the third embodiment of the present invention; and FIG. 7 is a cross-sectional view of a pump for circulating water according to the fourth embodiment of the present invention.

The present invention is described in detail below with reference to the accompanying drawings.

MODE FOR THE INVENTION

FIG. 1 is a perspective view illustrating a pump for circulating water according to the present invention. FIG. 2 is an exploded perspective view illustrating a pump for circulating water according to the present invention.

As illustrated in FIG. 1 and FIG. 2, the pump for circulating water according to the present invention comprises an upper housing 10, a lower housing 20, an impeller 50 and a rotator 60, and may further comprise an inner housing 30, optionally.

The upper housing of the present invention is formed with an inlet 11 and an outlet 12 of fluid. Also, the upper housing may have a protruding shape in a circular cap shape at the center, and the edge part thereof has preferably a structure where a flange part is formed to be coupled with the lower housing 20 or the inner housing 30. Also, the inlet 11 may have a protruding shape from an inner side of the upper housing in the shape of a pipe. The outlet 12 may protrude, in the shape of a pipe, in a direction perpendicular to the inlet 11 to be interconnected with the internal space of the impeller 50. Meanwhile, the upper housing 10 may have a portion formed at the center thereinside, to which the upper part of an impeller rotation shaft 55 is combined.

The lower housing 20 of the present invention is arranged and installed to fit in a lower side of the upper housing 10, and has a space therein in which the inner housing 30 or the impeller 50 is located. Preferably, it is formed in a cylindrical shape of which the lower part is sealed. The lower housing 20 may have a space formed at the center thereinside, on which a shaft supporting part 32 of the inner housing 30 is mounted. The upper outer circumferential surface of the inner housing 30 is coupled with the upper housing 10 or the inner housing 30. A stator 70 may be embedded in the lower housing 20. For the embedment, preferably, the stator is located in an injection molding machine and manufactured by an injection molding method.

The inner housing 30 of the present invention, an optional component, is located between the upper housing 10 and the lower housing 20, to separate the spaces of the housings. The inner housing 30 is configured to have an impeller receiving space 31 formed therein for receiving part of the impeller 50. The present invention is distinguished into the first and second embodiments (see FIG. 3 and FIG. 4) which comprise the inner housing 30, and the third and fourth embodiments (see FIG. 5 and FIG. 6) which do not comprise the inner housing 30. In the embodiments where the inner housing 30 is not comprised, the impeller receiving space 31 refers to the space inside the lower housing 20. The shaft supporting part 32, to which the impeller rotation shaft 55 is fixed, is formed in a lower part of the center of the inner housing 30. In the embodiments where the inner housing 30 is not comprised, the shaft supporting part 32 may be formed in a lower part of the center of the lower housing 20.

The inner housing 30, which is installed between the upper housing 10 and the lower housing 20, is formed with the impeller receiving space 31 in the middle part for receiving the impeller 50, and the shaft supporting part 32 in the lower part of the center of a bottom part of the impeller receiving space 31.

The impeller 50 is rotatably inserted inside the upper housing 10 and in the impeller receiving space 31, so as to substantially perform the pumping action. The flow pathway 40 is formed between the outer surface of the impeller body 51 and the inner surface of the inner housing 30 or lower housing 20. The impeller 50 comprises the impeller body 51, a shaft insertion hole 51*a* at the center of the impeller body 51 for combining the impeller rotation shaft 55, an impeller upper cover 56 installed in the upper part of the impeller body 51 and an impeller lower cover 57 (not illustrated in FIG. 3, but see FIG. 4 to FIG. 7) installed in the lower part of the impeller body 51. That is, the impeller body 51 formed in a cylindrical shape has the shaft insertion hole 51*a* vertically penetrating the body.

The rotor 60 of the present invention is installed in a rotor insertion part 51*d* formed inside the outer circumference of the impeller 50, and is formed of a magnet in the shape of a circular ring magnetized with the north polar and the south polar repetitively, so as to be inserted in a rotor receiving space 51*d*' of the impeller body 51. The present invention forms the pumping portion performing the pumping action and the rotor portion integrally as one body.

To be specifically described with reference to the exploded perspective view of FIG. 2 and the first embodiment of the present invention illustrated in FIG. 4, an introduction groove 51*b* through which fluid passes is concavely formed in the upper part of the impeller body 51. While receiving the rotor 60 by embedding the rotor 60 in the rotor receiving space 51*d*' of the rotor receiving part 51*d* installed around the lower part of the impeller body 51, a plurality of wing pieces 53 are formed around the upper part of the body formed with the introduction groove 51*b*. Further, a coupling hole for coupling the impeller upper cover 56 is formed on the upper surface of each of the wing piece 53.

The impeller rotation shaft 55 of the present invention may comprise a shaft supporting member 51*c* installed on its outer circumferential surface and inserted into the shaft insertion hole 51*a*, to support the rotation of the impeller. Further, the impeller upper cover 56 is formed with a combination boss 56*a* inserted into the coupling hole formed in the wing piece 53 at a lower surface of the body having a circular plate shape, and a penetrating hole 56*b* interconnected with the inlet 11 and the insertion groove 51*b* of the impeller body 51. The impeller lower cover 57 is combined with the lower part of the impeller body 51 to seal the rotor receiving space 51*d*'. Reference numeral 57*a* denotes a rotation shaft passing hole, 57*b* denotes an insertion protrusion, and 57*c* denotes a fluid passing hole.

The stator 70 of the present invention, which is installed at a position to fit in with the rotor 60 for electromagnetic induction with the rotor 60, comprises a core 71 winded, an upper core supporting member 72 combined with the upper part to support the upper side of the core 71, and a lower core supporting member 73 combined with the lower part to support the lower side of the core 71. The core 71 is formed in a structure having a plurality of core teeth protruding towards the inside of the body which has the overall shape of an approximately circular ring shape. The upper core supporting member 72 and the lower core supporting member 73 are the upper surface and lower surface of ring-shaped plate, and formed in a shape having a plurality of guide protrusions. In the drawings, reference numeral 80 denotes a circuit substrate, and reference numeral 90 denotes a power supply connector.

According to the conventional pump, when performing input and discharge of fluid, part of the fluid that is input and air included in the fluid intrude into the flow pathway 40 to be collected in the lower part of the impeller body 51. At that time, bubbles occur because of the collected fluid while driving the pump, and accordingly noise and excessive vibration may be generated, thereby deteriorating the efficiency of the pump. In order to overcome this problem, the present invention aims to discharge the fluid inside the flow pathway 40 to the upper side smoothly. The impeller 50 of the present invention is formed with a plurality of vertical discharge holes 52A interconnected with the flow pathway 40 in the body 51 of the impeller 50 so that the fluid inside the flow pathway 40 is discharged to the upper side, and with a plurality of horizontal discharge holes 52B interconnected with the plurality of vertical discharge holes 52A at an inside surface of the impeller body 51 between the lower part of a base plate 54 formed with the wing piece 53 of the impeller and the upper part of the rotor receiving part 51*d* having the rotor receiving space 51*d*', so as to mix fluid inside the flow pathway 40 rising through the horizontal discharge hole 52B and fluid introduced through the inlet 11 in a mixing space S and discharge the mixed fluid through the outlet 12. The impeller 50 having such structure is illustrated in FIG. 3, FIG. 4 and FIG. 6. Meanwhile, the embodiments illustrated in FIG. 5 and FIG. 7 of the present invention, the vertical discharge hole 52A is formed to be penetrated towards the introduction groove 51*b*.

This structure may enable to discharge fluid present inside the flow pathway 40 to the outside; however, unpleasant noise may be caused by air or fluid left in the discharge holes 52A, 52B when the pump operates in a transition state. Thus, a separate means needs to be sought to completely discharge the air or fluid. Thus, according to the present invention, a spring 65 is mounted on the lower surface of the impeller body 51, such that the spring 65 in the lower part of the impeller body 51 performs the pumping action which pushes the impeller body 51 upwards when the impeller body 51 moves downwards slightly by a pressure generated from the fluid introduced. Thus, the present invention can completely discharge the problematic air and fluid from the discharge holes 52A, 52B.

To additionally describe the effect of the present invention, while raising part of the fluid and air residing in the flow pathway 40 through the plurality of vertical discharge holes 52A or the plurality of horizontal discharge holes 52B interconnected with the vertical discharge holes by the suction force generated from the rotation of the wing piece 53 during high speed rotation of the impeller 50, they are mixed with the fluid introduced through the inlet 11 and discharged through the outlet 12, thereby performing smooth circulation of the fluid, and preventing the rising of the impeller 50 by inhibiting the generation of bubbles and cavitation, etc. Also, since fluid inside the flow pathway 40 is discharged through the mixing space S without colliding with the wing piece 53 of the impeller 50, excessive vibration or noise can be reduced, and also the durability can be improved by avoiding damage to the impeller 50. Further, through smooth flow of fluid, the water pressure difference between the upper part and the lower part of the impeller 50 can be the same, thereby greatly improving the efficiency of the pump. In addition, the air left in the discharge holes 52A and 52B can be effectively discharged by the pumping action of the impeller body 51 due to elasticity of the spring 65, thereby reducing unnecessary noise generated when the pump operates in a transition state.

The plurality of vertical discharge holes 52A of the present invention are provided at symmetrical points having the same semidiameter with respect to the shaft insertion hole 51*a* of the impeller body 51 so as to avoid eccentric rotation during the rotation of the impeller 50, thereby preventing abrasion or damage of the components.

FIG. 5 is a cross-sectional view illustrating the second embodiment of the present invention. The second embodiment of the present invention is the same as the first embodiment except that the horizontal discharge holes 52B are not formed, and the vertical discharge holes 52A are formed to be penetrated from the lower surface of the impeller body 51 towards the introduction groove 51*b*.

FIG. 6 is a cross-sectional view illustrating the third embodiment of the present invention. The third embodiment of the present invention does not apply the inner housing 30 in the first embodiment. Since the inner housing 30 is not provided, the lower housing 20 serves as the inner housing 30. Thus, the spring 65 is positioned in a spring insertion groove 35' formed in the inside surface of the center of the impeller 50 and the lower housing 20. FIG. 6 does not illustrate the stator 70 embedded inside the inner housing 20, etc.

FIG. 7 is a cross-sectional view illustrating the fourth embodiment of the present invention. The fourth embodiment of the present invention does not apply the inner housing 30 in the second embodiment. Since the inner housing 30 is not provided, the lower housing 20 serves as the inner housing 30. Thus, the spring 65 is positioned in the spring insertion groove 35' formed in the inside surface of the center of the impeller 50 and the lower housing 20. As in FIG. 6, FIG. 7 does not illustrate the stator 70 embedded inside the inner housing 20, etc.

The above description explains the pump for circulating water 100 performing the pumping action, which circulates heated water to a place of use such as a heating mat, etc. However, the present invention may be applied to a circulation pump performing input and discharge of fluid which is not water, and explanation is omitted on a heating means, etc. according to the power supply added to the pump for circulating water.

Although the present invention is described as above with reference to embodiments, the embodiments are merely examples and do not limit the present invention. Also, it should be understood that various modifications and applications which are not exemplified in the above can be made by those skilled in the art within a scope not deviating from the essential properties of the present embodiments. In addition, it should be interpreted that differences associated with such modifications and applications fall within the scope of the present invention as prescribed by the appended claims.

The invention claimed is:

1. A pump for circulating water, comprising:

an upper housing (10) formed with an inlet (11) and an outlet (12) of the water;

a lower housing (20) arranged in a lower side of the upper housing (10), having a space formed therein;

an inner housing (30) having an edge part interposed between the upper housing (10) and the lower housing (20), and an impeller receiving space (31) formed in a middle part of the inner housing;

an impeller (50) received inside the upper housing (10) and in the impeller receiving space (31) to be rotatably installed, so as to form a flow pathway (40) between the impeller (50) and an inner surface of the inner housing (30) for the flow of the water;

a rotor (60) installed inside an outer circumference of the impeller (50);

a spring (65) installed between a lower surface of the impeller and the inner housing; and a stator (70) installed inside the lower housing (20), wherein a plurality of vertical discharge holes (52A) are formed in an impeller body (51) and interconnected with the flow pathway (40), and a plurality of horizontal discharge holes (52B) are formed in the impeller body (51) between a wing piece (53) and a rotor receiving part (51*d*) and interconnected with the plurality of vertical discharge holes (52A), wherein the spring (65) is mounted on a lower surface of the impeller body (51), and wherein when the impeller body (51) moves downwards by pressure of the water flowing into the inlet (11), the spring (65) pushes the impeller body (51) upwards such that the impeller body (51) moves upwards and downwards by the pressure of the water and the spring (65).

2. The pump for circulating water of claim 1, wherein a spring insertion groove in which the spring is located is formed at a center inside the inner housing.

3. A pump for circulating water, comprising:

an upper housing (10) formed with an inlet (11) and an outlet (12) of the water;

a lower housing (20) arranged in a lower side of the upper housing (10) to be combined with the upper housing, having an impeller receiving space (31) therein;

an impeller (50) received inside the upper housing (10) and in the impeller receiving space (31) to be rotatably installed, so as to form a flow pathway (40) between the impeller (50) and an inner surface of the lower housing (20) for the flow of the water;

a rotor (60) installed inside an outer circumference of the impeller (50);

a spring (65) installed between a lower surface of the impeller and the lower housing; and a stator (70) embedded inside the lower housing (20), wherein a plurality of vertical discharge holes (52A) are formed in an impeller body (51) and interconnected with the flow pathway (40), and a plurality of horizontal discharge holes (52B) are formed in the impeller body (51) between a wing piece (53) and a rotor receiving part (51*d*) and interconnected with the plurality of vertical discharge holes (52A), wherein the spring (65) is mounted on a lower surface of the impeller body (51), and wherein when the impeller body (51) moves downwards by pressure of the water flowing into the inlet (11), the spring (65) pushes the impeller body (51) upwards such that the impeller body (51) moves upwards and downwards by the pressure of the water and the spring (65).

4. The pump for circulating water of claim 3, wherein a spring insertion groove in which the spring is located is formed at a center inside the lower housing.

* * * * *